US005504564A

United States Patent [19]

Snelling et al.

[11] Patent Number: 5,504,564

[45] Date of Patent: Apr. 2, 1996

[54] VIBRATORY ASSISTED DIRECT MARKING METHOD AND APPARATUS

[75] Inventors: Christopher Snelling, Penfield; Dale R. Mashtare, Macedon, both of N.Y.

[73] Assignee: Xerox Corporation, Stamford, Conn.

[21] Appl. No.: 352,941

[22] Filed: Dec. 9, 1994

[51] Int. Cl.[6] ..... G03G 15/14

[52] U.S. Cl. ..... 355/273; 355/210; 355/245; 355/271

[58] Field of Search ..... 355/210–213, 355/271–273, 245, 254; 430/120–122, 45, 47, 48; 118/655, 661; 347/153, 154, 139

[56] References Cited

U.S. PATENT DOCUMENTS

| | | | |
|---|---|---|---|
| 2,968,552 | 1/1962 | Gundlach | 96/1 |
| 3,653,758 | 4/1972 | Trimmer et al. | 355/273 |
| 3,741,117 | 6/1973 | Bienert et al. | 355/271 X |
| 3,924,945 | 12/1975 | Weigl | 355/271 X |
| 4,833,503 | 5/1989 | Snelling | 355/259 |
| 4,851,926 | 7/1989 | Ishikawa | 358/300 |
| 4,931,876 | 6/1990 | Hashizume | 358/300 |
| 4,987,456 | 1/1991 | Snelling et al. | 355/273 |
| 5,005,054 | 4/1991 | Stokes et al. | 355/273 |
| 5,010,369 | 4/1991 | Nowak et al. | 355/273 |
| 5,016,055 | 5/1991 | Pietrowski et al. | 355/273 |
| 5,025,291 | 6/1991 | Nowak et al. | 355/273 |
| 5,053,821 | 10/1991 | Kunugi et al. | 355/245 |
| 5,081,500 | 1/1992 | Snelling | 355/273 |
| 5,153,615 | 10/1992 | Snelling | 346/153.1 |
| 5,172,163 | 12/1992 | Yamaoki et al. | 355/210 |
| 5,210,577 | 1/1993 | Nowak | 355/273 |
| 5,272,508 | 12/1993 | Sakakibara et al. | 355/211 X |
| 5,276,484 | 1/1994 | Snelling | 355/211 |
| 5,282,005 | 1/1994 | Nowak et al. | 355/273 |
| 5,282,006 | 1/1994 | Fletcher | 355/273 |
| 5,329,341 | 7/1994 | Nowak et al. | 355/273 |
| 5,346,791 | 9/1994 | Ozawa et al. | 430/122 X |
| 5,353,105 | 10/1994 | Gundlach et al. | 355/279 |
| 5,357,324 | 10/1994 | Montfort | 355/273 |
| 5,374,978 | 12/1994 | Asanae et al. | 355/210 |

*Primary Examiner*—Matthews S. Smith
*Attorney, Agent, or Firm*—Duane C. Basch

[57] ABSTRACT

The present invention is a method and apparatus for producing an image on the image receiving member. The method and apparatus employ a photoconductive member that is charged by the deposition of charged marking particles on an outer surface thereof. Subsequently, selective regions of the photoconductor are selectively exposed to light patterns to cause the photoconductor to exhibit a photoresponse, thereby collapsing the internal electric field in the exposed regions but not in the unexposed regions. When a field neutralizing bias and acoustic energy are applied in a transfer region, toner in the unexposed regions is transferred to an intermediate member or any substrate interposed between the photoconductive surface and the biasing electrode.

24 Claims, 4 Drawing Sheets

VIBRATORY ASSISTED DIRECT MARKING METHOD AND APPARATUS

This invention relates generally to a direct marking imaging process, and more particularly to an imaging method and apparatus in which toner particles are selectively released from a photoreceptor surface under the assistance of vibratory energy so as to form a developed image on an image receiving member.

CROSS REFERENCE

The following related application is hereby incorporated by reference for its teaching, "Color Printing System," by Snelling, application No. 08/283,366, filed Aug. 1, 1994.

BACKGROUND AND SUMMARY OF THE INVENTION

The present invention is directed to a direct marking imaging process. Heretofore, a number of patents and publications have disclosed direct marking or acoustically assisted imaging processes, the relevant portions of which may be briefly summarized as follows:

U.S. Pat. No. 2,968,552 to Gundlach, issued Jan. 17, 1961, discloses a method for the simultaneous creation and development of an electric field through changing electric fields in response to a pattern of light and shadow. The invention further discloses the elimination of one or more steps of conventional xerographic operations, specifically cleaning operations necessary for the reuse of the photoconductor. Operation of the invention is accomplished by depositing marking particles on an upper surface of a photoconductor, exposing the particles and photoconductor to a high voltage corona discharge to cause a charge to be deposited on the surface, placing a print receiving pellicle in contact with the surface bearing the particles, and exposing the transparent backing of the photoconductor to a pattern of light and shadow so as to transfer developer material to the print receiving surface.

U.S. Pat. No. 4,833,503 to Snelling, issued May 23, 1989, teaches a multi-color printer employing sonic toner release development. Development is accomplished by vibrating the surface of a toner carrying member and thereby reducing the net force of adhesion of the toner to the surface of the toner carrying member.

U.S. Pat. No. 5,081,500 to Snelling, issued Jan. 14, 1992, discloses an electrophotographic device wherein a vibratory element is employed to uniformly apply vibratory energy to the back side of a charge retentive member having a developed image on the front side thereof. The vibratory energy applied enables the transfer of toner across a gap in those regions characterized by non-intimate contact between the charge retentive member and a copy sheet.

U.S. Pat. No. 5,153,615 to Snelling, issued Oct. 6, 1992, teaches a printing method and apparatus employing a pyroelectric material so as to directly mark an image on a print substrate. The image is produced by locally exposing a uniformly toned pyroelectric member to heat so as to cause the reversal of the charge polarity attracting the toner to the member, and thereby repelling the toner from the toned surface and toward a print substrate in close proximity thereto.

In accordance with the present invention there is provided a method of producing an image on an image receiving member in a direct marking apparatus having an endless photoconductive member with an inner layer, a charge retentive outer layer, and a conductive electrode layer interposed between the inner and outer layers, including the steps of:

(a) uniformly depositing, on an outer surface of the photoconductive member, electrically charged marking particles, said particles being deposited thereon by an electrically biased developer and attracted thereto;

(b) selectively exposing regions of the photoconductive member to a light source so as cause the collapse of the electric field in the exposed regions;

(c) applying an electrical bias to the image receiving member, spaced apart from the outer surface of the photoconductive member, to generate an electric field in a gap between the image receiving member and the photoconductive member; and (d) applying acoustic energy to the photoconductive member so as to further reduce adhesive forces present between the outer surface of the photoconductive member and the marking particles, said acoustic energy being of sufficient magnitude to enable only the marking particles present on the surface of the photoconductive member in the unexposed regions to be transferred to an outer surface of the image receiving member under the force of the electric field.

In accordance with another aspect of the present invention, there is provided a printing apparatus, comprising:

an endless photoconductive member having an inner layer, a charge retentive outer layer, and a conductive electrode layer between the inner and outer layers;

charged marking particles uniformly deposited on an outer surface of the photoconductive member and held in relative contact therewith;

means for selectively exposing the photoconductive member to light to produce both exposed and unexposed regions therein and to thereby cause the collapse of the electric field in the exposed regions;

an image receiving member, spaced apart from the outer surface of the photoconductive member, for receiving the marking particles, said image receiving member having an electrical bias applied thereto to neutralize an electric field present in a gap between the image receiving member and the exposed regions of the photoconductive member; and means for applying acoustic energy to the photoconductive member so as to further reduce adhesive forces present between the outer surface of the photoconductive member and the marking particles, said acoustic energy applying means applying acoustic energy having sufficient magnitude to enable only the marking particles present on the surface of the photoconductive member in the unexposed regions to be transferred to an outer surface of the image receiving member.

In accordance with yet another aspect of the present invention, there is provided a multi-color printing apparatus for producing an image on a recording sheet, comprising:

an intermediate member;

a plurality of direct marking devices for depositing marking material on an outer surface of said intermediate member to produce an image thereon, each of said direct marking devices including, an endless photoconductive member having an inner layer, a charge retentive outer layer, and a conductive electrode layer between the inner and outer layers, charged marking particles on an outer surface of the photoconductive member and held in relative contact therewith by an electric field created by the charged particles being deposited on the photoconductive member, means for selectively exposing the photoconductive member to light to produce both exposed and unexposed regions therein and to thereby cause the collapse of the electric field in the exposed regions, an image receiving member, spaced apart from the outer surface of the photoconductive member, for receiving the marking particles, said image receiving member having an electrical bias applied thereto to neutralize an electric field present in a gap between the image receiving member and the exposed regions of the photoconductive member, and means for applying acoustic energy to the photoconductive member so as to further reduce adhesive forces present between the outer surface of the photoconductive member and the marking particles, said acoustic energy applying means applying acoustic energy having sufficient magnitude to enable only the marking particles present on the surface of the photoconductive member in the unexposed regions to be transferred to an outer surface of the image receiving member;

a heater, in communication with an internal surface of said intermediate member, for heating said intermediate member so as to cause the tackification of the marking particles deposited on the outer surface thereof; and means, defining a nip with the outer surface of said intermediate member, for transferring the tackified marking particle image to the recording sheet passing through the nip defined by said intermediate member and said transferring means, whereby the tackified marking particle image is cooled upon contact with the recording sheet to become permanently fixed to the surface thereof.

One aspect of the invention is based on the discovery that the hardware of a direct marking system can be simplified, and system reliability improved by using the vibratory assist techniques described herein. More specifically, the present invention requires no high voltage power supplies, no corona charging devices, no photoreceptor cleaning station or hardware. Furthermore, the present invention enables non-interactive toner deposition so as to allow multi-color images to be produced by a single-pass marking system. This discovery avoids problems that arise in xerographic processes requiring contact between the photoconductor and the surface to which a toner image is to be transferred. The technique described herein is advantageous because it is efficient, simple, and relatively inexpensive compared to other well-known imaging approaches. In addition, it can be used in single color or multiple color printing and reprographic systems. A wide variety of operations can be implemented using these techniques, some of which are described in the embodiments that follow.

Figure 1:
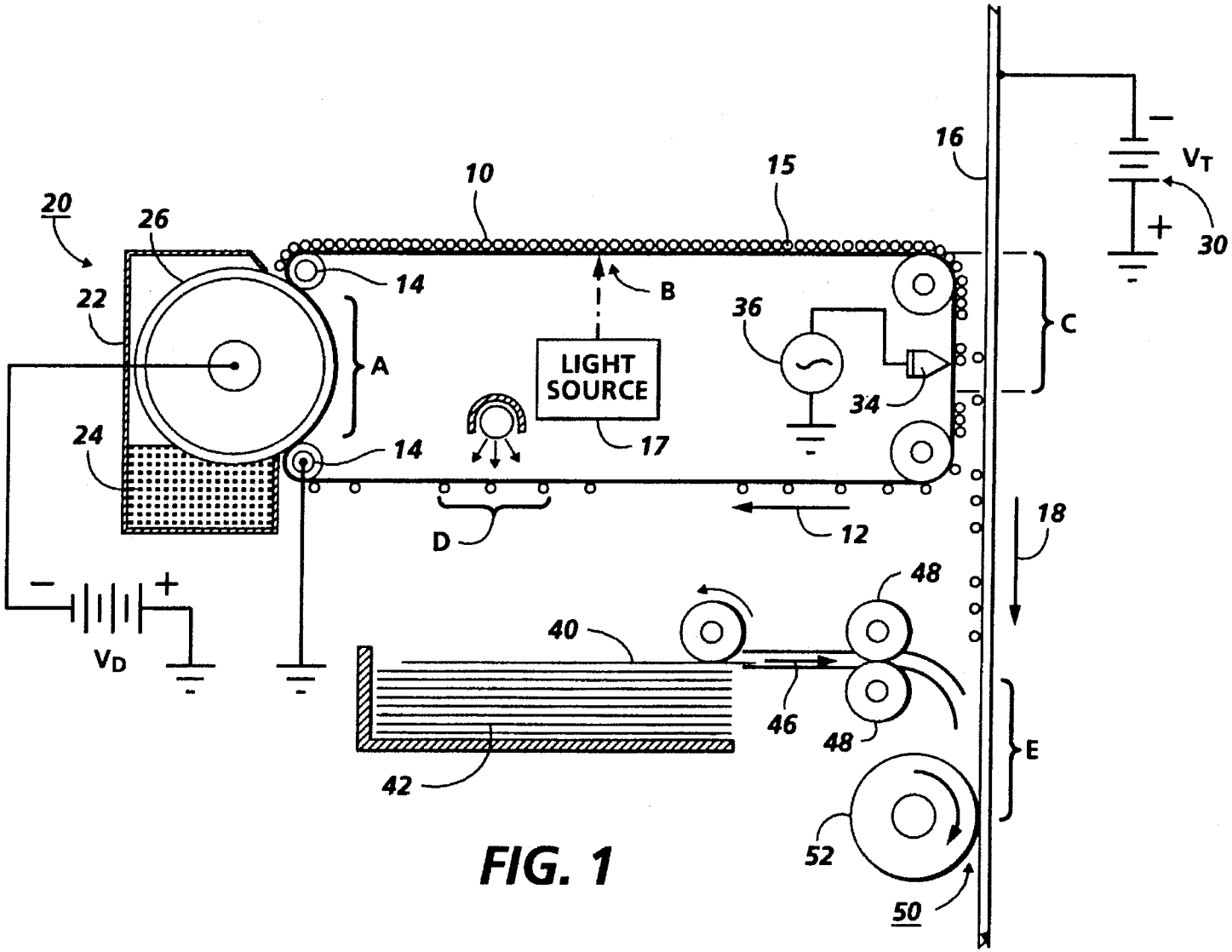
FIGS. 1 is a schematic elevational view of a single-color printing machine incorporating the present invention.
Figure 2:
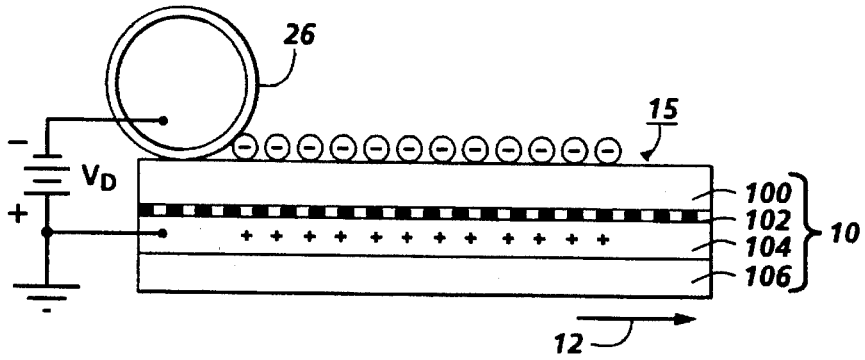
FIGS. 2–5 are enlarged views of a photoreceptor section showing details of the sonic toner release imaging process employed by the printer of FIG. 1.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

For a general understanding of a printing machine in which the features of the present invention may be incorporated, reference is made to FIG. 1, which schematically depicts the various components thereof. Although the direct marking apparatus is particularly well adapted for use in the machine of FIG. 1, it should be evident from the following discussion that it is equally well suited for use in a wide variety of printing, duplicating and facsimile devices.

Generally, in the printing machine of FIG. 1, a photoconductive member 10 such as a flexible belt is rotated in the direction indicated by arrow 12 through various processing stations by rolls 14. One of the rolls 14 is preferably a drive roll suitable for imparting a driving force to photoconductive member 10. After loading a uniform toner layer 15 on the photoconductive member at station A, it rotates through an exposure station B where selected regions of the member are exposed to radiant energy such as light. Once exposed, the attractive forces holding the toner particles to the member in the unexposed regions are significantly lower than those in the exposed regions. More specifically, the electric field holding the toner particles to the outer surface of member 10 is collapsed in the exposed regions of the photoreceptor, thereby increasing the attraction of the charged marking particles. Thus, the collapsed electric field also results in a differential in the external field above the toner layer.

After exposure, member 10 rotates to transfer station C where the outer surface is brought into close proximity with an intermediate member 16. Under the assistance of an electric field and applied acoustic energy, toner particles present on the unexposed regions of the photoconductive member are transferred to intermediate member 16. In one embodiment, intermediate member 16 may be a belt or similar reusable member to which the image is transferred before final transfer to a printed sheet. Subsequently photoconductive member 10 continues to rotate through illumination station D where any electric fields remaining are neutralized by exposure to a radiant energy source prior to returning to toner loading station A to repeat the process. Simultaneously, intermediate member 16 continues in the direction indicated by arrow 18 to transfer—fixing (transfix) station E where the toner image thereon is transferred and fixed or fused to the surface of a copy sheet passing therethrough, in registration with the image on intermediate member 16, to produce a printed sheet. In an alternative embodiment, the intermediate member may be a suitable print medium, such as a sheet of paper, where the image transferred thereto at transfer station C remains on the surface of the sheet and is the permanently affixed thereto by a known fusing or fixing process.

Operation of the aforedescribed processing stations will now be described in detail in conjunction with the illustrations of FIGS. 2 through 5. In a preferred embodiment, photoconductive member 10 is a flexible, active matrix photoreceptor belt. As specifically illustrated in FIG. 2, photoconductive member 10 includes: a top transport layer 100 of, for example, N,N'-diphenyl-N,N'-bis(3 methyl phenyl)-1,1' biphenyl-4,4' diamine (m-TBD) in polycarbonate; a generator layer 102 of dispersed trigonal selenium in polyvinylcarbazole; a flexible, transparent electrode layer 104; and a bottom support layer 106. Although member 10 is preferably a flexible member, in an alternative embodiment a rigid photoconductive member may be employed. Initially, member 10 moves through toner loading station A where the developer unit, indicated generally by reference numeral 20 applies a uniform layer of toner or similar marking particles to the outer surface thereof. Developer unit 20 comprises developer housing 22 for maintaining a supply of development material 24 therein. The developer material generally comprises magnetic carrier granules with charged toner particles adhering triboelectrically thereto. Developer unit 20 is preferably a magnetic brush development system where the developer material is moved through a magnetic flux field causing a brush 26 to form.

The surface of photoconductive member 10 is "toned" by bringing the top layer into contact with the electrically biased magnetic brush 26. The brush is biased, as indicated, by a direct current potential $V_D$ produced by low voltage power supply 28. Voltage $V_D$ may be applied with respect to ground using a grounded, conductive roll as illustrated in FIG. 1. For example, drive roll 14 or another suitable commutative method in contact with the conductive electrode layer 104 of belt 10. In this manner, the toner particles on magnetic brush 26 are electrostatically attracted to photoconductive member 10, thereby forming a uniform toner layer on the surface thereof. Deposition of the particles on the outer surface of the photoconductive member produces an electric field within the photoconductive member, holding the particles to the surface thereof by coulombic attraction to an electrostatic image charge induced in the conductive electrode layer 104. Furthermore, deposition of the charged toner onto the upper surface of member 10 in darkness simultaneously establishes an electric field through the photoreceptor (illustrated as "–" and "+" in FIG. 2), thereby making it light sensitive. In one embodiment, a magnetic brush developer was employed using a –400 volt bias potential $V_D$, resulting in an approximately 270 volt surface potential being produced on the photoconductive member and the deposited toner layer.

Figure 7:
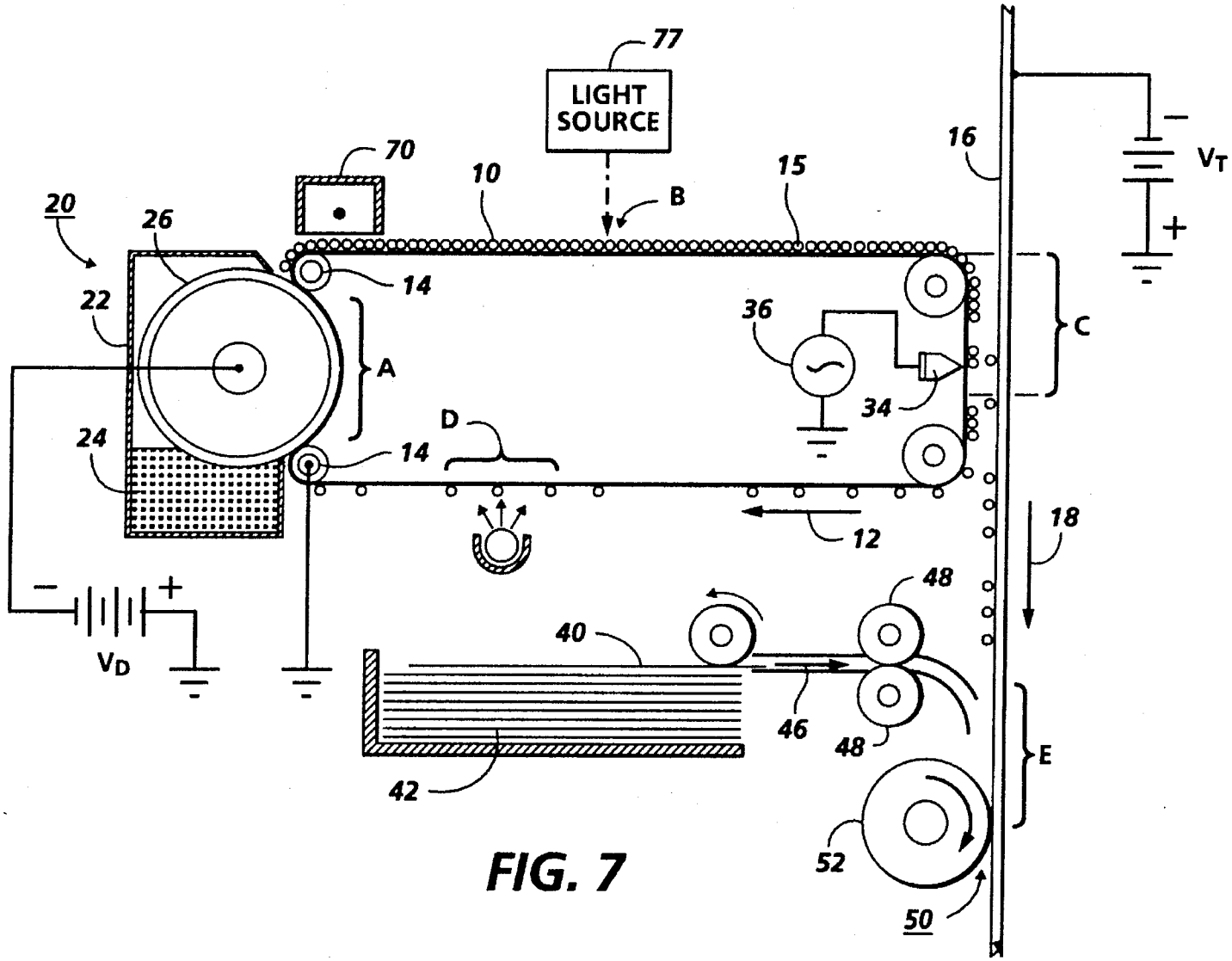
FIG. 7 is a schematic elevational view of a single-color printing machine incorporating the present invention wherein the light source for exposing the photoreceptor with image information and the neutralization radiant energy source are located outside of the photoreceptor.

In an alternative embodiment, the relevant portion of which is illustrated in FIG. 7, a common corona charging device 70 may be employed to further charge the photoconductive donor 10 and the associated toner layer 15. The corona charging device, it is believed, will increase the magnitude of the electric field attracting the toner particles to the surface and assure that the field is uniform across the surface of member 10 as well. If necessary or desired, the alternative use of supplemental charging by the corona or equivalent charging devices will likely improve the contrast of the transferred image by increasing the differential between the magnitudes of the electric fields in the exposed and unexposed regions of the photoconductive member.

Continuing with a detailed description of FIG. 1, photoconductive member 10, having been coated with a layer of toner particles 15, is rotated in the direction of arrow 12 to move the uniformly covered surface to exposure station B. At exposure station B, light of a predetermined wavelength is directed at the rear of the transparent member, so as to cause a photoresponse in the photoresponsive layers for all regions exposed by the light. Exposure may be accomplished, as illustrated by a selectively controllable light source 17, such as a laser-based raster output scanning device (ROS) or any equivalent exposure means suitable for generating a pattern of light and dark regions corresponding to the image to be printed, on the inner surface of member 10. For example, a light-emitting diode (LED) array may be employed to selectively expose photoconductor or a commonly known light-lens optical system may be employed to expose a large section of the photoreceptor inner surface using light reflected from the surface of a document to be reproduced. It is further noted that the present system may generally be characterized as a "write-white" system, wherein the exposed regions of the photoconductive member do not subsequently transfer toner to the intermediate member, but where the unexposed regions do.

The ROS or other exposure apparatus that comprise source 17 may be driven by an electronic subsystem (not shown) in accordance with image data received from either a print source (not shown) or from an image input device (not shown). The print source may be any suitable raster input generation system, for example, a computer generated document. Likewise, the image input device may be any well known raster input device capable of digitizing an image on an original document to produce a digital document. Generally, the output of the image input device is transferred to the electronic subsystem for subsequent output to the ROS . The electronic subsystem may also act as an image processing device, capable of correcting and/or modifying the digitized data in accordance with a set of predefined requirements.

As yet another alternative, again illustrated in FIG. 7, the light source 77 may be positioned outside the circumference of the photoconductive member. In such an embodiment, light source 77 is understood to be of sufficient intensity so as to cause the exposure of the photoconductive member through toner layer 15. While the embodiment may exhibit marginal success for imaging of black or dark color toners, lighter colors, including cyan, magenta, and especially yellow toners exhibit sufficient transmittance of the exposure light to enable the through-toner exposure. With through-toner exposure, as illustrated by FIG. 7, the need for a transparent or translucent photoconductive member is eliminated. Furthermore, any difficulties of placing the light source or equivalent exposure device, and necessary optics components, within the circumference of the photoconductive member are overcome.

Figure 3:
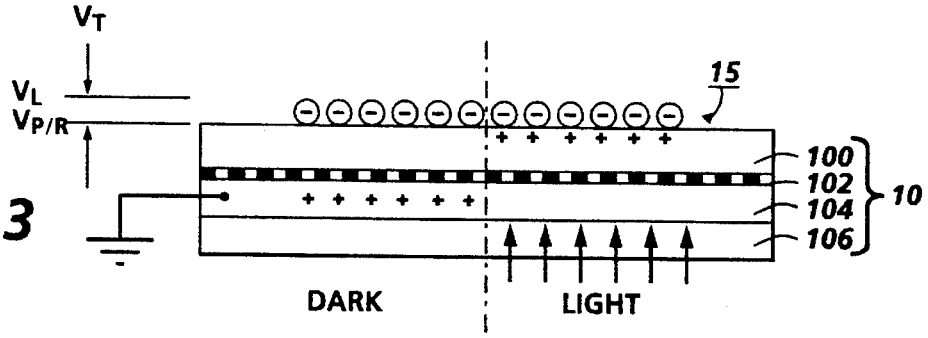

In the second step or station, as illustrated by FIG. 3, exposure through the bottom surface of the transparent photoconductive member collapses the electric field across photoconductive layers 100 and 102 in the illuminated or exposed regions. As indicated, the surface potential of the toner loaded photoconductive member, belt 10, is reduced in the exposed regions from $V_L$ to $V_T$. More specifically, the surface potential varies between the exposed and unexposed regions and may be represented as:

$$V_L=V_T+V_{P/R} \quad (1)$$

where $V_T$ represents the potential drop across the toner layer and $V_{P/R}$ represents the potential drop across the active matrix photoreceptor layers of belt 10.

After exposure at station B, photoconductive member 10 is advanced to transfer station C, where the outer surface of the belt is brought into close proximity with intermediate member 16. The selective transfer of toner particles from the unexposed regions of belt 10 to intermediate member 16 is accomplished by applying a biasing voltage and acoustic vibration within transfer station C. Preferably the bias voltage is applied to the intermediate member. Alternatively, in an embodiment where the intermediate member is a nonconductive member such as a sheet of paper, the bias voltage would be applied to an electrode positioned on the opposite side of the intermediate member away from the photoconductive member. Having collapsed the electric field within the photoreceptor in the regions exposed at station B, the attractive forces holding the toner particles to the surface of photoconductive member 10 are of greater magnitude than those holding the particles in the unexposed regions as a result of the applied bias voltage. Preferably the bias voltage has a magnitude approximately equal to $V_T$, and is applied by a second DC power supply 30 so as to neutralize an electric field present in the gap or space between the exposed regions of photoconductive member 10 and the intermediate member 16.

Figure 4:
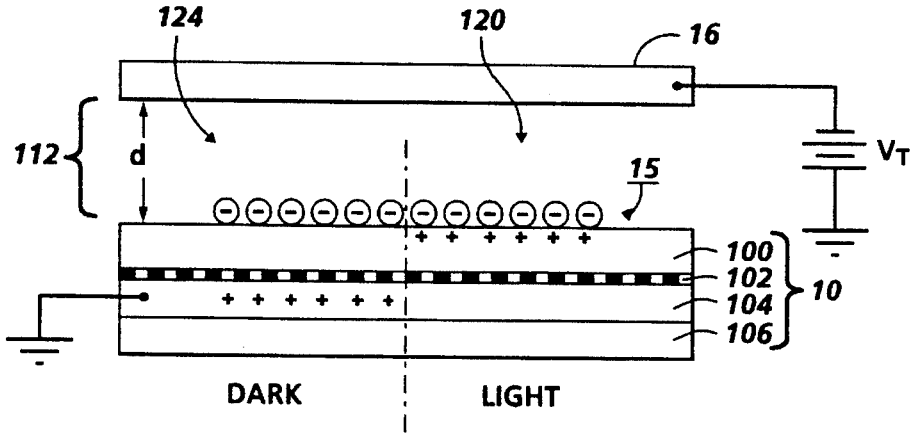

Referring to the detail in FIG. 4, biasing voltage $V_T$ is applied to the intermediate member 16 (or alternatively an electrode behind a nonconductive member 16) to neutralize the electric field across the gap or space above the exposed regions indicated by reference numeral 112, where the gap or separation distance is further indicated by the character d. The electric field (E) may be characterized by the following equations:

$$E_{unexposed} = \frac{V_L - V_T}{d} = \frac{V_{P/R}}{d} \quad (2)$$

$$E_{exposed} = 0 \quad (3)$$

where the field varies between the exposed and unexposed regions. The small decrease in $V_{P/R}$ due to capacitive coupling with the intermediate member, although present, has been neglected in this simplified description. In one embodiment, a biasing voltage $V_T$ of about 150 volts was applied to an intermediate member spaced a distance of approximately 500 microns (μ) or about 0.0020 inches. This resulted in a potential drop from the intermediate member to the photoconductive member electrode layer of approximately 120 volts, which in turn produced an electric field (E) of approximately 0.24 v/μ in the unexposed regions. Hence, in the regions exposed by light at station B, region 120, the electric field is essentially zero or slightly reversed, while for the unexposed regions, region 124, the electric field remains.

Figure 5:
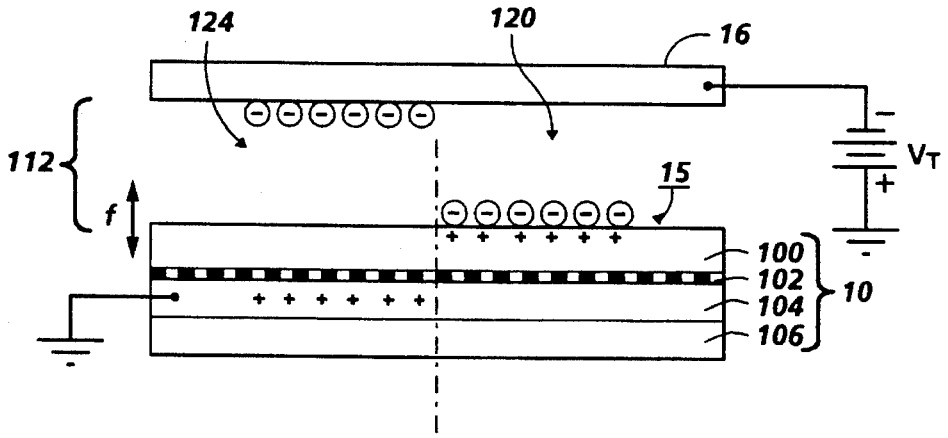

In addition to the biasing voltage, acoustic energy is applied in transfer station C by, for example, an acoustic resonator 34 similar to that disclosed in U.S. Pat. No. 5,081,500 issued Jan. 14, 1992 to Snelling, and hereby incorporated by reference for its teachings. Resonator 34 is a high frequency acoustic or ultrasonic resonator driven by an A.C. source 36 at a frequency f between 20 KHz and 200 KHz, preferably about 60 KHz. Moreover, the tip of the resonator contacting the inner surface of member 10 is preferably operated at a velocity of approximately 300 mm/sec. As illustrated in the detail of FIG. 5, the result of the applied acoustic energy at frequency f is a sufficient reduction in the net adhesion of toner particles 15 to the surface of photoconductive member 10 to enable the force created as a result of electric field E to transport the toner particles in unexposed region 124 across gap 112 and into contact with the intermediate member 16. Although the particles in exposed region 120 also have acoustic energy imparted thereto, there is no electric field to transport the toner particles across the gap.

Once transfer is completed, the exposed/transferred portion of photoconductive member 10 is rotated to illumination station D where any electric fields remaining in the belt are neutralized by exposure of the inner surface of the photoconductive member to a radiant energy source prior to returning to toner loading station A. The acoustic energy may also be applied at station C by a piezoelectric shoe in riding contact with the rear or inner surface of photoconductive member 10 at station C. As yet another alternative, sufficient acoustic energy could be produced using a piezoactive member in the manner described by Snelling in U.S. Pat. No. 5,276,484, issued Jan. 4, 1994, the relevant portions thereof being hereby incorporated by reference. For example, photoconductive member 10 may further include a piezo-active layer that when a high frequency alternating signal is applied across the layer a piezoelectric response is generated which causes the layer to vibrate.

Coincident with the rotation of member 10, a substrate sheet is advanced to marking station E. In operation, substrate sheet 40 is advanced from stack 42 and fed into position, so as to register and maintain the sheet in contact with the surface of intermediate member 16. Generally, sheet 40 is advanced by feed roll 44, towards marking station E in a direction generally indicated by arrow 46. Sheet 40, which may be any suitable image receiving substrate, is fed and deskewed by feed roll 44 until sufficiently engaged by secondary feed rolls 48, where it is driven to engage intermediate member 16 at nip 50. At nip 50, intermediate member 16 contacts heated fuser roll 52 so as to transfer and permanently fix the toner particles to the surface of substrate 40 to produce the printed image.

Figure 6:
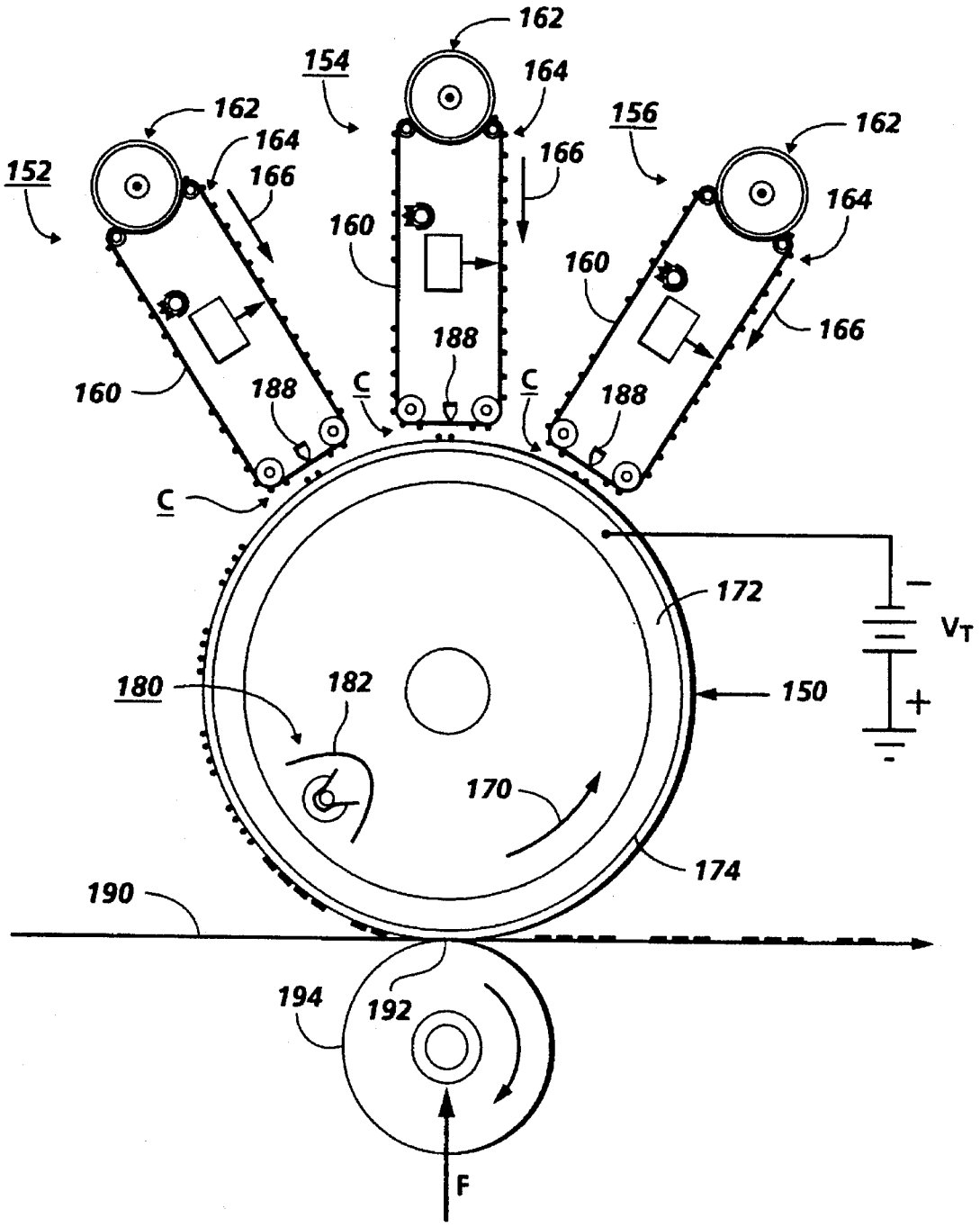
FIG. 6 is a schematic elevational view of a multi-color printing machine incorporating the present invention.

As a further alternative, illustrated in FIG. 6, the aforedescribed marking method and apparatus may be replicated in one or more additional positions along the path of a fuser-roll-imaging intermediate member to implement a multi-color marking process as described in co-pending application No. 08/055,331 by Gundlach et al, for a "Method and Apparatus for Imaging on a Heated Intermediate Member," filed Jun. 22, 1993, and hereby incorporated by reference for its teachings.

Generally, the heated intermediate roll process depicted in FIG. 6 utilizes a common intermediate member 150 and a plurality of direct marking apparatus as described above, each direct marking apparatus depositing a different color on the intermediate member. As described each marking apparatus 152, 154 and 156 includes a photoconductive belt 160 and an electrically biased magnetic brush developer 162 for applying a uniform toner layer 164 on the outer surface of the belt. However, each of the marking apparatus preferably contains a different color of toner in the magnetic brush developer, for example, cyan, magenta, and yellow, respectively. As belts 160 are rotated in the direction indicated by arrows 166, through the various processing stations previously described, intermediate member 150 is advanced in the direction indicated by arrow 170.

Intermediate member 150 may be either a rigid roll or an endless belt having a path defined by a plurality of rollers in contact with the inner surface thereof. As depicted in FIG. 6, intermediate member 150 is preferably a dual layer roll having an inner core 172 made of a rigid, high thermal conductivity material, such as aluminum, so that heat applied to the inside thereof by heater 180, preferably a common incandescent-type fuser heater, is rapidly conducted to the upper, resilient surface layer 174. Heater 180 further includes a radiation deflection shield 182 that focuses the emitted radiation to a localized area around or slightly upstream of the transfix nip so as to prevent thermal interactions with the direct marking apparatus 152, 154, and 156 at the transfer stations indicated in FIG. 6 by the reference character C. Surface layer 174 may be any commonly known coating which resists the adhesion of solid and tackified toner particles, yet is capable of conducting heat from the inner core of intermediate member 150. For example, possible surface layers would include Teflon™ (including TFE or FEP fluorocarbon polymers), VitOn™ (a fluoroelastomer of vinylidene fluoride and hexafluoro-propylene), and equivalent polymers exhibiting no-stick, chemically resistive properties.

The selective transfer of toner particles from the unexposed regions of the surface of photoconductive belts 160, to intermediate member 150 is accomplished through the use of an applied bias and acoustic energy. More specifically, neutralizing bias VT is applied to inner core 172 by a roll or commutator in contact therewith (not shown). This generates the necessary electric field for transfer, while resonators 188 apply acoustic energy in response to a sine-wave A.C. input as described previously, culminating in the transfer of toner from the unexposed regions of the outer surfaces of belts 160 to the outer surface of intermediate member 150.

Subsequent to receiving toner for the color image to be produced from marking apparatus 152, 154 and 156 in seriatim, intermediate member 150 continues to rotate in the direction indicated by arrow 170. Because each of the individual marking apparatus are physically separated from intermediate member 150 by a small yet controlled gap, the deposition of the multiple color toners on the intermediate member can be accomplished without affecting subsequent toner deposition or transfixing. The size of the gap should be less than 500 μ, and preferably less than 250 μ, but should not be so small as to result in contact between the marking apparatus and the intermediate member at any time. In this way, a multicolor image can be "built-up" on a single pass of intermediate member 150 and immediately transfixed to the surface of recording sheet 190.

Transfixing occurs at nip 192, where intermediate member 150 and pressure roll 194 are mechanically biased into contact with one another by a normal force represented by reference numeral F. As the toner transferred to the outer surface of intermediate member 150 passes within the area of heater 180, the toner is tackified so that when contacted by recording sheet 190 in nip 192, the toner immediately transfers and solidifies without the need for further fusing or similar fixing operations.

It is further believed that additional color marking stations can be added to the multicolor system depicted in FIG. 4 to provide a black toner capability as well. Moreover, a combination of one or more direct or indirect marking techniques may be employed in conjunction with the present invention. For example, it is possible to use an indirect marking technique, such as an ionographic technique, to apply black toner to the intermediate member in conjunction with a direct marking technique, such as the imaging process described herein, which would be used to provide one or more additional toner colors to be annotated or added to the black image. In this manner highlight or multicolor images could be produced. Similarly, it is conceivable that a printing machine employing an indirect marking process to generate a single color image on a recording sheet may employ the aforedescribed heated intermediate member imaging techniques to annotate such an image with additional or different color image information via the heated fuser roll.

In recapitulation, the present invention is a direct marking method and apparatus for producing an image on the image receiving member. The method and apparatus employ a photoconductive member that is charged by the deposition of charged marking particles on an outer surface thereof. Subsequently, regions of the photoconductor are selectively exposed to light patterns to cause the photoconductor to exhibit a photoresponse, thereby collapsing the internal electric field in the exposed regions but not in the unexposed regions. When a field neutralizing bias and acoustic energy are applied in a transfer region, toner in the unexposed regions is transferred to an intermediate member or any substrate interposed between the photoconductive surface and the biasing electrode.

It is, therefore, apparent that there has been provided, in accordance with the present invention, a method and apparatus that employs acoustic energy to enable direct marking from unexposed regions of a photoconductive member. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A method of producing an image on an image receiving member in a direct marking apparatus having an endless photoconductive member with an inner layer, a charge retentive outer layer, and a conductive electrode layer interposed between the inner and outer layers, including the steps of:

(a) uniformly depositing, on an outer surface of the photoconductive member, electrically charged marking particles, said particles being deposited thereon by an electrically biased developer and attracted thereto;

(b) selectively exposing regions of the photoconductive member to a light source so as cause the collapse of the electric field in the exposed regions;

(c) applying an electrical bias to the image receiving member, spaced apart from the outer surface of the photoconductive member, to generate an electric field in a gap between the image receiving member and the photoconductive member; and (d) applying acoustic energy to the photoconductive member so as to further reduce adhesive forces present between the outer surface of the photoconductive member and the marking particles, said acoustic energy being of sufficient magnitude to enable only the marking particles present on the surface of the photoconductive member in the unexposed regions to be transferred to an outer surface of the image receiving member under the force of the electric field.

2. The method of claim 1, wherein the step of uniformly depositing electrically charged marking particles on the outer surface of the photoconductive member produces an electric field within the photoconductive member by coulombic attraction to an electrostatic image charge induced in the conductive electrode layer.

3. The method of claim 1, wherein the inner conductive electrode layers of the photoconductive member are transparent and the step of selectively exposing regions of the photoconductive member comprises selectively exposing the transparent inner layer with light directed at the inner surface of the photoconductive member.

4. The method of claim 1, wherein the step of selectively exposing regions of the photoconductive member comprises selectively exposing the outer layer of the photoconductive member with light transmitted through the particles deposited thereon.

5. The method of claim 1, wherein the step of applying acoustic energy to the photoconductive member includes the steps of:

generating a high frequency alternating signal; and applying the high frequency alternating signal to a resonator in contact with an inner surface of the photoconductive member.

6. The method of claim 1, wherein the photoconductive member includes a piezo-active layer therein and where the step of applying acoustic energy to the photoconductive member includes the steps of:

generating a high frequency alternating signal; and applying the high frequency alternating signal to the piezoactive layer in the photoconductive member to induce vibration therein.

7. The method of claim 1, wherein the step of applying acoustic energy to the photoconductive member includes the steps of:

generating a high frequency alternating signal; and applying the high frequency alternating signal to a piezoelectric device in contact with an inner surface of the photoconductive member.

8. The method of claim 1, wherein the image receiving member is a removable recording sheet and where the step of applying an electrical bias to the image receiving member includes the step of inserting the removable recording sheet between an electrode, having an electrical bias applied thereto, and the photoconductive member so as to generate an electric field in a gap between the removable recording sheet and the photoconductive member.

9. A method of producing an image on an image receiving member in a direct marking apparatus having an endless photoconductive member with an inner layer, a charge retentive outer layer, and a conductive electrode layer interposed between the inner and outer layers, including the steps of:

(a) uniformly depositing, on an outer surface of the photoconductive member, electrically charged marking particles, said particles being deposited thereon by an electrically biased developer and attracted thereto;

(b) charging the photoconductive member and electrically charged marking particles deposited thereon with a corona charging device;

(c) selectively exposing regions of the photoconductive member to a light source so as cause the collapse of the electric field in the exposed regions;

(d) applying an electrical bias to the image receiving member, spaced apart from the outer surface of the photoconductive member, to generate an electric field in a gap between the image receiving member and the photoconductive member; and (e) applying acoustic energy to the photoconductive member so as to further reduce adhesive forces present between the outer surface of the photoconductive member and the marking particles, said acoustic energy being of sufficient magnitude to enable only the marking particles present on the surface of the photoconductive member in the unexposed regions to be transferred to an outer surface of the image receiving member under the force of the electric field.

10. A printing apparatus, comprising:

an endless photoconductive member having an inner layer, a charge retentive outer layer, and a conductive electrode layer between the inner and outer layers;

charged marking particles uniformly deposited on an outer surface of the photoconductive member and held in relative contact therewith;

means for selectively exposing the photoconductive member to light to produce both exposed and unexposed regions therein and to thereby cause the collapse of the electric field in the exposed regions;

an image receiving member, spaced apart from the outer surface of the photoconductive member, for receiving the marking particles, said image receiving member having an electrical bias applied thereto to neutralize an electric field present in a gap between the image receiving member and the exposed regions of the photoconductive member; and means for applying acoustic energy to the photoconductive member so as to further reduce adhesive forces present between the outer surface of the photoconductive member and the marking particles, said acoustic energy applying means applying acoustic energy having sufficient magnitude to enable only the marking particles present on the surface of the photoconductive member in the unexposed regions to be transferred to an outer surface of the image receiving member.

11. The printing apparatus of claim 10, wherein said charged marking particles deposited on the surface of the photoconductive member are attracted to the surface by coulombic attraction to an electrostatic image charge induced in the conductive electrode layer.

12. The printing apparatus of claim 11, wherein the charge induced in the conductive electrode layer is about 270 volts.

13. The printing apparatus of claim 10, wherein said acoustic energy applying means comprises:

a signal generator for producing an alternating high frequency signal; and a resonator in contact with an inner surface of the photoconductive member, to which the alternating high frequency signal is applied to vibrate said photoconductive member.

14. The printing apparatus of claim 10, wherein said photoconductive member includes a piezo-active layer therein and where said acoustic energy applying means comprises a high frequency alternating signal generator, electrically connected to the piezo-active layer so as to cause the vibration of said photoconductive member in response to the high frequency alternating signal.

15. The printing apparatus of claim 10, wherein said acoustic energy applying means comprises:

a signal generator for producing an alternating high frequency signal; and a piezoelectric device, responsive to the alternating high frequency signal and in contact with an inner surface of the photoconductive member, to cause the vibration of said photoconductive member in response to the signal.

16. The printing apparatus of claim 10, wherein:

the inner and conductive layers of said photoconductive member are transparent; and said selective exposure means is located interior to the circumference of said photoconductive member to expose said photoconductive member with light directed at the inner surface thereof.

17. The printing apparatus of claim 16, wherein said selective exposure means is a device selected from the group consisting of:

a raster output scanner;

an array of light emitting diodes; and a light-lens optical system.

18. The printing apparatus of claim 10, wherein said selective exposure means selectively exposes the outer layer of the photoconductive member with light transmitted through the particles deposited thereon.

19. The printing apparatus of claim 18, wherein said selective exposure means is a device selected from the group consisting of:

a raster output scanner;

an array of light emitting diodes; and a light-lens optical system.

20. The printing apparatus of claim 10, wherein said image receiving member comprises:

a dual layer roll including a heat conducting inner core and an outer surface layer; and a heater, disposed interior to said dual layer roll, for emitting radiation to a localized area of said roll so as to tackify the toner particles transferred to the outer surface thereof prior to transfixing the tackified particles to a removable recording sheet.

21. The printing apparatus of claim 10, wherein said image receiving member comprises:

an electrically biased electrode having a first surface opposite said photoconductive member; and a removable recording sheet interposed between the first surface of said biased electrode and said photoconductive member.

22. A printing apparatus, comprising:

an endless photoconductive member having an inner layer, a charge retentive outer layer, and a conductive electrode layer between the inner and outer layers;

charged marking particles uniformly deposited on an outer surface of the photoconductive member and held in relative contact therewith;

a corona charging device for charging the photoconductive member and electrically charged marking particles deposited thereon;

means for selectively exposing the photoconductive member to light to produce both exposed and unexposed regions therein and to thereby cause the collapse of an electric field in the exposed regions;

an image receiving member, spaced apart from the outer surface of the photoconductive member, for receiving the marking particles, said image receiving member having an electrical bias applied thereto to neutralize an electric field present in a gap between the image receiving member and the exposed regions of the photoconductive member; and means for applying acoustic energy to the photoconductive member so as to further reduce adhesive forces present between the outer surface of the photoconductive member and the marking particles, said acoustic energy applying means applying acoustic energy having sufficient magnitude to enable only the marking particles present on the surface of the photoconductive member in the unexposed regions to be transferred to an outer surface of the image receiving member.

23. A multi-color printing apparatus for producing an image on a recording sheet, comprising:

an intermediate member;

a plurality of direct marking devices for depositing marking material on an outer surface of said intermediate member to produce an image thereon, each of said direct marking devices including, an endless photoconductive member having an inner layer, a charge retentive outer layer, and a conductive electrode layer between the inner and outer layers, charged marking particles on an outer surface of the photoconductive member and held in relative contact therewith by an electric field created by the charged particles being deposited on the photoconductive member, means for selectively exposing the photoconductive member to light to produce both exposed and unexposed regions therein and to thereby cause the collapse of the electric field in the exposed regions, an image receiving member, spaced apart from the outer surface of the photoconductive member, for receiving the marking particles, said image receiving member having an electrical bias applied thereto to neutralize an electric field present in a gap between the image receiving member and the exposed regions of the photoconductive member, and means for applying acoustic energy to the photoconductive member so as to further reduce adhesive forces present between the outer surface of the photoconductive member and the marking particles, said acoustic energy applying means applying acoustic energy having sufficient magnitude to enable only the marking particles present on the surface of the photoconductive member in the unexposed regions to be transferred to an outer surface of the image receiving member;

a heater, in communication with an internal surface of said intermediate member, for heating said intermediate member so as to cause the tackification of the marking particles deposited on the outer surface thereof; and means, defining a nip with the outer surface of said intermediate member, for transferring the tackified marking particle image to the recording sheet passing through the nip defined by said intermediate member and said transferring means, whereby the tackified marking particle image is cooled upon contact with the recording sheet to become permanently fixed to the surface thereof.

24. A printing apparatus, comprising:

an endless photoconductive member having an inner layer, a charge retentive outer layer, and a conductive electrode layer between the inner and outer layers;

charged marking particles uniformly deposited on an outer surface of the photoconductive member and held in relative contact therewith;

means for selectively exposing the photoconductive member to light to produce regions having a collapsed electric field;

an image receiving member, spaced apart from the outer surface of the photoconductive member, for receiving marking particles, said image receiving member having an electrical bias applied thereto to neutralize an electric field present in a gap between the image receiving member and those regions of the photoconductive member having the collapsed electric field; and means for applying vibratory energy to the marking particles present on the photoconductive member so as to further reduce adhesive forces present between the outer surface of the photoconductive member and the marking particles, said vibratory energy applying means applying energy of sufficient magnitude to enable only the marking particles present on the surface of the photoconductive member in the regions having the collapsed electric field to be transferred to an outer surface of the image receiving member.

* * * * *